US007003254B2

(12) United States Patent
Tokuzaki

(10) Patent No.: US 7,003,254 B2
(45) Date of Patent: Feb. 21, 2006

(54) FIXING APPARATUS AND IMAGE FORMING APPARATUS INCLUDING THE SAME

(75) Inventor: Masaaki Tokuzaki, Daito (JP)

(73) Assignee: Funai Electric Co., Ltd., Daito (JP)

( * ) Notice: Subject to any disclaimer, the term of this patent is extended or adjusted under 35 U.S.C. 154(b) by 0 days.

(21) Appl. No.: 11/029,504

(22) Filed: Jan. 6, 2005

(65) Prior Publication Data

US 2005/0147434 A1 Jul. 7, 2005

(30) Foreign Application Priority Data

Jan. 7, 2004 (JP) ..... 2004-001622

(51) Int. Cl.
*G03G 15/20* (2006.01)

(52) U.S. Cl. ..... 399/328; 399/122

(58) Field of Classification Search ..... 399/328, 399/122

See application file for complete search history.

(56) References Cited

U.S. PATENT DOCUMENTS 4,147,501 A * 4/1979 Goshima et al. ..... 432/60
5,170,214 A * 12/1992 Negoro et al. ..... 399/326

FOREIGN PATENT DOCUMENTS

| | | |
|---|---|---|
| JP | 54-48255 | 4/1979 |
| JP | 56-89215 | 7/1981 |
| JP | 58-105106 | 7/1983 |
| JP | 2-266385 | 10/1990 |

OTHER PUBLICATIONS

English abstracts for cited references JP2-266385a and JP54-48255A.*

* cited by examiner

*Primary Examiner*—Quana Grainger
(74) *Attorney, Agent, or Firm*—Crowell & Moring LLP

(57) ABSTRACT

An electromagnetic valve mounting portion is formed by upwardly cutting a bottom surface of a frame and bending the upwardly cut portion like a L-shape in such a manner as to have a top surface part extending in substantially parallel with the bottom surface thereof. The electromagnetic valve mounting portion includes a top stationary part, whose top surface part has a U-shaped cutout part, and a pair of bottom supporting parts formed by upwardly bending both side portions of a bottom opening part, which is formed in the upwardly cut portion.

6 Claims, 10 Drawing Sheets

FIXING APPARATUS AND IMAGE FORMING APPARATUS INCLUDING THE SAME

BACKGROUND OF THE INVENTION

1. Field of the Invention

The present invention relates to a fixing apparatus and to an image forming apparatus including the same. More particularly, the invention relates to a fixing apparatus having an electromagnetic valve attaching portion, and to an imaging apparatus including such a fixing apparatus.

2. Description of the Related Art

Hitherto, an image forming apparatus including a fixing apparatus provided with an electromagnetic valve attaching portion has been known (see, for examples, JP-UM-A-56-89215 and JP-UM-A-58-105106).

The JP-UM-A-56-89215 discloses a structure of a first example of the conventional apparatus, in which a catching portion is provided on an outer surface of a flange of a solenoid (a electromagnetic valve), and a caught portion is provided in a yoke (an electromagnetic valve mounting portion) by being cut upwardly from a chassis (a frame). In this structure disclosed in the JP-UM-A-56-89215, the solenoid (the electromagnetic valve) and the yoke (the electromagnetic valve mounting portion) are fixed by engaging the catching portion provided on the flange of the solenoid (the electromagnetic valve) with the caught portion of yoke (the electromagnetic valve mounting portion).

Further, the JP-UM-A-58-105106 discloses a structure of a second example of the conventional apparatus, in which the solenoid (the electromagnetic valve) is fixed by using metal fittings, each of which are provided with claw elements, and a frame element provided with a groove that engages with the claw elements of the metal fittings. Concretely, according to the JP-UM-A-58-105106, the solenoid (the electromagnetic valve) is fixed by fitting the claw elements of the metal fittings into the groove of the frame element.

FIG. 15 is a perspective view illustrating the entire configuration of a laser printer including a conventional fixing apparatus provided with a pressure releasing mechanism. FIG. 16 is a side view, which is taken in the direction of an arrow B and illustrates the conventional fixing apparatus of the laser printer shown in FIG. 15. FIG. 17 is a top view illustrating a pressure releasing mechanism of the conventional fixing apparatus shown in FIG. 16. FIG. 18 is a view illustrating a state in which an electromagnetic valve of the pressure releasing mechanism of the conventional fixing apparatus shown in FIG. 17 is energized. FIG. 19 is a perspective view illustrating an exploded condition of the electromagnetic valve of the pressure releasing mechanism of the conventional fixing apparatus. FIG. 20 is a perspective view illustrating amounted condition of a cam and the electromagnetic valve in the pressure releasing mechanism of the conventional fixing apparatus. Incidentally, the conventional fixing apparatuses each having the pressure releasing mechanism are disclosed in, for example, JP-A-54-48255 and JP-A-2-266385. First, the configuration of a conventional laser printer 200 is described by referring to FIG. 15. In the laser printer 100 including a conventional fixing apparatus that has an electromagnetic valve mounting portion, as shown in FIG. 15, a toner cartridge 102 for transferring an image on recording paper 101 by using toner is detachably mounted. A fixing apparatus 103 for fixing a toner image formed with toner, which is transferred by the toner cartridge 102, on the recording paper 101 is provided at the rear side of the toner cartridge 102. This fixing apparatus 103 is supported by a frame 104. Further, a gear 105 for rotating a fixing roller 106, (see FIG. 16) provided in the fixing apparatus 103 is provided on a side portion of the fixing apparatus 103.

Next, the entire configuration of the conventional fixing apparatus having the electromagnetic mounting portion is described hereinbelow by referring to FIG. 16. As shown in FIG. 16, an entrance guide 107 for guiding the recording paper 101 toward the fixing roller 106 is provided at the entrance side of the fixing apparatus 103. The fixing roller 106 for fixing a toner image, which is transferred to the recording paper 101, by heating the recording paper 101 is provided in a sheet feeding direction of an entrance guide 107. This fixing roller 106 is constituted by a metallic tube having a built-in heater (not shown) for heating the paper. Further, two bearings for rotatably supporting the fixing roller 106 are attached to both sides of the fixing roller 106, respectively.

Furthermore, a pressure roller 109 for pressing the recording paper 101 against the fixing roller 106 is provided under the fixing roller 106 in such a way as to be brought into contact with the fixing roller 106 by a predetermined pressing force. A bearing 111 for rotatably supporting the pressure roller 109 is attached to an end portion of a shaft 110 of this pressure roller 109. This bearing 111 is held by a bearing holding member 113 fitted into a concave portion 112*a* of a crank-plate 112.

Further, this crank-plate 112 is rotatably mounted on a shaft 114 serving as a supporting point. An extension coil spring 115 is attached to a spring attaching portion 112*b* of the crank-plate 112. This extension coil spring 115 is pressed in such a way as to turn the crank-plate 112 in a direction in which the pressure roller 109 pushes the fixing roller 106.

Furthermore, a separating claw 116 is placed in the sheet feeding direction of the fixing roller 106 in such a way as to be pressed against the surface of the fixing roller 106 by an elastic force of a torsion coil spring 117. A discharge guide 118 for guiding the recording paper 101 in a discharging direction is attached to a lower portion of the torsion coil spring 117. Moreover, paired upper and lower discharging rollers 119 for discharging the recording paper 101 to the outside of the fixing apparatus 103 are provided above and under the discharge guide 118, respectively.

Next, the detail structure of the pressure releasing mechanism of the conventional fixing apparatus is described hereinbelow by referring to FIGS. 16 to 20. As shown in FIGS. 16 to 20, this pressure releasing mechanism of the conventional fixing apparatus includes a crank-plate 112, an extension coil spring 115, a crankshaft 120, a cam 121, an electromagnetic valve 122, a cam/electromagnetic-valve mounting member 123, a shaft screw 124, a nut 125, and a screw 126.

As shown in FIGS. 16 and 17, end portions 120*a* and 120*b* formed by bending both tip end parts of the crankshaft 120 in directions almost orthogonal to each other are provided therein. Further, as shown in FIGS. 16 to 18, a cam 121 includes a cam shaft 121*a*, an electromagnetic valve abutting portion 121*b*, and an engaging portion 121*c*. Furthermore, as shown in FIG. 19, the electromagnetic valve 122 includes an E-ring 122*a*, a compression coil spring 122*b*, a nut 122*c*, a body portion 122*d*, and a rod portion 122*e*. This body portion 122*d* is provided with a nut mounting portion 122*f*, and a throughhole 122*g*, through which the rod portion 122*e* is passed. The rod portion 122*e* is provided with a groove 122*h* to which the E-ring 122*a* is fitted. Also, the rod portion 122*e* has a movable tip portion 122*i* provided at the top end thereof. Furthermore, as shown in FIGS. 16 and 20, a cam/electromagnetic-valve member 123 includes paired upper and lower axial screw holes 123*a*, an electromagnetic valve mounting hole 123*b*, and two leg portions 123*c*.

Further, as shown in FIG. 16, one of the end portions 120*a* of the crankshaft 120 engages with the engaging hole 112*c* of the crank-plate 112. Further, the other end portion 120*b* of the crankshaft 120 engages with the engaging hole 121*c* of the cam 121. Additionally, the cam 121 is provided at the electromagnetic mounting member 123 by the axial screw 124, which is inserted into the paired upper and lower axial screw insertion holes 123*a* of the cam/electromagnetic-valve mounting member 123, in such a way as to be able to turn around the cam shaft 121*a* serving as a supporting point. Further, the electromagnetic valve 122 is attached to the cam/electromagnetic-valve member by inserting the nut mounting portion 122*f* of the electromagnetic valve 122 into the electromagnetic valve mounting hole 123*b* of the cam/electromagnetic valve mounting member 123 and then screwing the nut 122*c* thereon. Further, the movable tip portion 122*i* of the electromagnetic valve 122 abuts against the electromagnetic valve abutting portion 121*b* of the cam 121. Besides, in a state in which the pressure roller 109 is pressed against the fixing roller 106 by a pressing force of the extension coil spring 115, the movable tip portion of the electromagnetic valve 122 is in a retreated condition, as shown in FIG. 17. Furthermore, the cam/electromagnetic-valve mounting member 123 is fixed to a frame 104 by a screw 126, as shown in FIGS. 17 and 20.

Next, an operation of the conventional fixing apparatus 103 is described hereinbelow by referring to FIGS. 16 to 18. First, the recording paper 101, on which a toner image is transferred, is guided by the entrance guide 107, and inserted into between the fixing roller 106 and the pressure roller 109. The inserted recording paper 101 is heated by the fixing roller 106 having been heated to about 200. C. Also, the recording paper 101 is pressed by the pressure roller 109 against the surface of the fixing roller 106. Consequently, the toner image, which is transferred onto the recording paper 101, is fixed thereto. Then, the fixing roller 106 rotates in a conveying direction (clockwise) to thereby feed the recording paper 101, to which the toner image is fixed, to a discharging side. Subsequently, the recording paper 101 is separated from the surface of the fixing roller 106 by the separating claw 116 provided in such a manner as to touch the surface of the fixing roller 106.

Further, an operation of the pressure releasing mechanism of the conventional fixing apparatus 103 is performed as follows. First, when electric power is supplied to the electromagnetic valve 122 having been in a normal condition (see FIG. 17), the movable tip portion 122*i* of the electromagnetic valve 122 is driven in a direction of an arrow C in FIG. 17. Consequently, the electromagnetic valve abutting portion 121*b* is pressed by the movable tip portion 122*i* of the electromagnetic valve 122. Thus, the cam 121 turns around the cam shaft 121*a* serving as a supporting point (see FIG. 20) in a direction of an arrow D in FIG. 17. Then, the turn of the cam 121 in the direction of the arrow D in FIG. 17 causes the crankshaft 120, which connects the cam 121 to the crank-plate 112, to operate in such a way as to pull the crank-plate 112 horizontally (in a direction of an arrow E shown in FIG. 17). Consequently, as shown in FIG. 16, the crank-plate 112 turns around the shaft 114, which serves as a supporting point, against the force of the extension coil spring 115 in a direction (a direction of an arrow F in FIG. 16), so that the pressure applied to the fixing roller 106 by the pressure roller 109 is released. Thus, the apparatus is put into a condition shown in FIGS. 16 and 18. Consequently, the pressing force of the pressure roller 109 is released.

A third example of the conventional fixing apparatus shown in FIG. 16, which has an electromagnetic valve mounting portion, has a problem that the number of components is large because the pressure releasing mechanism includes nine components, that is, the crank-plate 112, the extension coil spring 115, the crankshaft 120, the cam 121, the electromagnetic valve 122, the cam/electromagnetic-valve the axial screw 124, the nut 125, and the screw 126.

Further, in the structure disclosed in the JP-UM-A-56-89215, the yoke (the electromagnetic valve mounting portion) for mounting the electromagnetic valve thereon is formed integrally with a chassis (a frame) by being cut upwardly from the chassis (the frame). However, in the case of using the electromagnetic valve (the solenoid), which is described in the JP-UM-A-56-89215, as a drive source for the pressure releasing mechanism of the conventional fixing apparatus shown in FIG. 15, this conventional apparatus has a disadvantage in that a cam mounting member for mounting the cam, which abuts against a movable iron core of the electromagnetic valve (the solenoid), should separately be provided therein. Consequently, even in the case of applying the structure, which is disclosed in the JP-UM-A-56-89215, to the conventional fixing apparatus, this conventional apparatus has the problem that the number of components thereof is large.

Furthermore, in the structure disclosed in the JP-UM-A-58-105106, two metal fittings and one frame element are needed for fixing the electromagnetic valve (the solenoid). Thus, this conventional apparatus has a disadvantage in that the number of components increases. Moreover, in the case of using the solenoid as a drive source for the pressure releasing mechanism of the conventional fixing apparatus shown in FIG. 15, screws or the like for mounting the frame element, to which the solenoid is fixed, on the frame of the fixing apparatus is additionally needed. In addition, the cam mounting member for mounting the cam, which abuts against a plunger of the electromagnetic valve, should separately be provided therein. Thus, this conventional fixing apparatus has the problem that the number of components thereof is large, similarly to the third example of the conventional fixing apparatus having the electromagnetic mounting portion.

SUMMARY OF THE INVENTION

The invention is accomplished to solve the aforementioned problems. An object of the invention is to provide a fixing apparatus, which has an electromagnetic valve mounting portion and is enabled to reduce the number of components thereof, and to provide an image forming apparatus including this fixing apparatus.

According to a first aspect of the invention, there is provided a fixing apparatus having a fixing roller, rotatably attached to a metallic frame, for fixing an image transferred to recording paper by heat, a pressure roller for pressing the recording paper against the fixing roller, and a pressure releasing mechanism for releasing a pressure applied to the fixing roller by the pressure roller. This fixing apparatus further includes an electromagnetic valve mounting portion for mounting the electromagnetic valve thereon. The pressure releasing mechanism includes a pair of crank-plates each supporting the pressure roller and being turnable around a predetermined supporting point, a spring member for pushing the pair of crank-plates in a direction so that the pressure applied to the fixing roller by the pressure roller is not released, a shaft member connecting the pair of crank-plates to each other and having a flat portion provided on a central portion of a bottom surface thereof, and an electromagnetic valve for turning the pair of crank-plates against a pushing force of the spring member by pushing up the central portion of the bottom surface of the shaft member. The electromagnetic valve mounting portion includes a top stationary portion that is formed by upwardly cutting the bottom surface of the frame and then bending an upwardly cut part of the bottom surface like a L-shape in such a way as to have a top surface part extending in substantially parallel with the bottom surface and that has a U-shaped cutout part in the top surface part, and also includes a pair of bottom supporting portions formed by upwardly bending both side parts of a bottom opening portion formed in the upwardly cut part.

As described above, in the fixing apparatus according to the first aspect of the invention, the electromagnetic valve mounting portion is configured in such a manner as to include a top stationary portion that is formed by upwardly cutting the bottom surface of the frame and then bending an upwardly cut part of the bottom surface like a L-shape in such a way as to have a top surface part extending in substantially parallel with the bottom surface and that has a U-shaped cutout part in the top surface part, and also include a pair of bottom supporting portions formed by upwardly bending both side parts of a bottom opening portion formed in the upwardly cut part. Thus, the electromagnetic valve mounting portion can be formed without processing the metallic frame to which the fixing roller is attached. Consequently, the electromagnetic valve mounting portion can be formed without adding a component thereto. Thus, as compared with the case of separately providing the electromagnetic valve mounting portion in the apparatus, the number of components can be reduced. Moreover, the pressure releasing mechanism is formed in such a way as to include a shaft member connecting the pair of crank-plates to each other and having a flat portion provided on a central portion of a bottom surface thereof, and also include an electromagnetic valve for turning the pair of crank-plates against a pushing force of the spring member by pushing up the central portion of the bottom surface of the shaft member. Thus, the crank-plates 12, which are provided on both sides of the mechanism, are turned by being driven by the signal electromagnetic valve, so that the pressure applied to the fixing roller by the pressure roller can be released from both sides thereof. Consequently, the releasing of the pressure can uniformly be performed on both the left and right sides of a region in which the pressure roller touches the fixing roller. Thus, wrinkles can effectively be prevented from being caused on a sealed letter, on which the fixing is performed in a state in which the pressure applied to the fixing roller by the pressure roller is released. Furthermore, the pressure releasing mechanism is formed in such a manner as to include a shaft member connecting the pair of crank-plates to each other and having a flat portion provided on a central portion of a bottom surface thereof, and also include an electromagnetic valve for turning the pair of crank-plates against a pushing force of the spring member by pushing up the central portion of the bottom surface of the shaft member. Thus, the electromagnetic valve can more surely push up the bottom surface of the shaft member, so that the pair of crank-plates can more surely be turned against the pushing force of the spring member. Consequently, the pressure applied to the fixing roller by the pressure roller can more surely be released.

According to a second aspect of the invention, there is provided having a fixing roller, rotatably attached to a metallic frame, for fixing an image transferred to recording paper by heat, a pressure roller for pressing the recording paper against the fixing roller, and a pressure releasing mechanism for releasing a pressure applied to the fixing roller by the pressure roller. The pressure releasing mechanism includes a pair of crank-plates each supporting the pressure roller and being turnable around a predetermined supporting point, a spring member for pushing the pair of crank-plates in a direction so that the pressure applied to the fixing roller by the pressure roller is not released, a shaft member connecting the pair of crank-plates to each other and having a flat portion provided on a central portion of a bottom surface thereof, and an electromagnetic valve for turning the pair of crank-plates against a pushing force of the spring member by pushing up the central portion of the bottom surface of the shaft member. The fixing apparatus further includes an electromagnetic valve mounting portion, formed by upwardly perpendicularly cutting a bottom surface of the metallic frame, for mounting thereon the electromagnetic valve having a U-shaped cutout portion, and a cam mounting portion, formed by bending a part of the metallic frame, for mounting the cam thereon.

As described above, in this fixing apparatus according to the second aspect of the invention, an electromagnetic valve mounting portion for mounting thereon the electromagnetic valve having a U-shaped cutout portion is provided by upwardly perpendicularly cutting a bottom surface of the metallic frame. Moreover, a cam mounting portion for mounting the cam thereon is provided by bending a part of the metallic frame. Thus, the electromagnetic valve mounting portion and the cam mounting portion can be formed by processing the metallic frame, to which the fixing roller is attached. Consequently, the electromagnetic valve mounting portion and the cam mounting portion can be formed without adding a component to the apparatus. Therefore, as compared with the case of separately providing the electromagnetic valve mounting portion and the cam mounting portion in the apparatus, the number of components can be reduced.

According to a third aspect of the invention, there is provided a fixing apparatus having a fixing roller, attached to a metallic frame, for fixing an image transferred to recording paper by heat, a pressure roller for pressing the recording paper against the fixing roller, and a pressure releasing mechanism for releasing a pressure applied to the fixing roller by the pressure roller. The pressure releasing mechanism includes an electromagnetic valve serving as a drive source. The metallic frame includes an electromagnetic valve mounting portion for mounting thereon an electromagnetic valve. The electromagnetic valve mounting portion includes a top stationary portion that is formed by upwardly cutting the bottom surface of the frame and then bending an upwardly cut part of the bottom surface like a L-shape in such a way as to have a top surface part extending in substantially parallel with the bottom surface and that has a U-shaped cutout part in the top surface part, and also includes a pair of bottom supporting portions formed by upwardly bending both side parts of a bottom opening portion formed in the upwardly cut part.

As described above, in this fixing apparatus according to the third aspect of the invention, the electromagnetic valve mounting portion for mounting thereon the electromagnetic valve constituting the pressure releasing mechanism for releasing the pressure applied to the fixing roller by the pressure roller is configured in such a manner as to include a top stationary portion that is formed by upwardly cutting the bottom surface of the metallic frame, to which the fixing roller is attached, and then bending an upwardly cut part of the bottom surface like a L-shape in such a way as to have a top surface part extending in substantially parallel with the bottom surface and that has a U-shaped cutout part in the top surface part, and also include a pair of bottom supporting portions formed by upwardly bending both side parts of a bottom opening portion formed in the upwardly cut part. Thus, the electromagnetic valve mounting portion can be formed by processing the metallic frame, to which the fixing roller is attached. Consequently, the electromagnetic valve mounting portion can be formed without adding a component thereto. Thus, as compared with the case of separately providing the electromagnetic valve mounting portion in the apparatus, the number of components can be reduced.

In the fixing apparatus according to the third aspect of the invention, preferably, the pressure releasing mechanism includes a pair of crank-plates each supporting the pressure roller and being turnable around a predetermined supporting point, a spring member for pushing the pair of crank-plates in a direction so that the pressure applied to the fixing roller by the pressure roller is not released, and a connecting portion for connecting the pair of crank-plates to each other. An electromagnetic valve is provided in such a way as to turn the pair of crank-plates against a pushing force of the spring member by depressing a bottom surface of the connecting member. With such a configuration, the crank-plates, which are provided on both sides of the mechanism, can be turned by being driven by the signal electromagnetic valve. Thus, the pressure applied to the fixing roller by the pressure roller can be released from both sides thereof. Consequently, the releasing of the pressure can uniformly be performed on both the left and right sides of a region in which the pressure roller touches the fixing roller. Thus, wrinkles can effectively be prevented from being caused on a sealed letter, on which the fixing is performed in a state in which the pressure applied to the fixing roller by the pressure roller is released.

In the fixing apparatus according to the third aspect of the invention, preferably, the connecting member includes a shaft member having a circular cross-section that has a flat portion at a predetermined place of a bottom surface thereof. The electromagnetic valve is placed in such a way as to turn the pair of crank-plates against a pushing force of the spring member by depressing a flat portion of the bottom surface of the connecting member. With such a configuration, the electromagnetic valve can more surely push up the bottom surface of the shaft member. Thus, the paired crank-plates can more surely be turned against the pushing force of the spring member. Consequently, the pressure applied to the fixing roller by the pressure roller can more surely be released.

An image forming apparatus of the invention may include the fixing apparatus according to the first, second or third aspect of the invention. With such a configuration, the invention can obtain an advantage in that the number of components of the image forming apparatus including the fixing apparatus is reduced.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Hereinafter, embodiments of the invention are described with reference to the accompanying drawings.

First Embodiment

Figure 1:
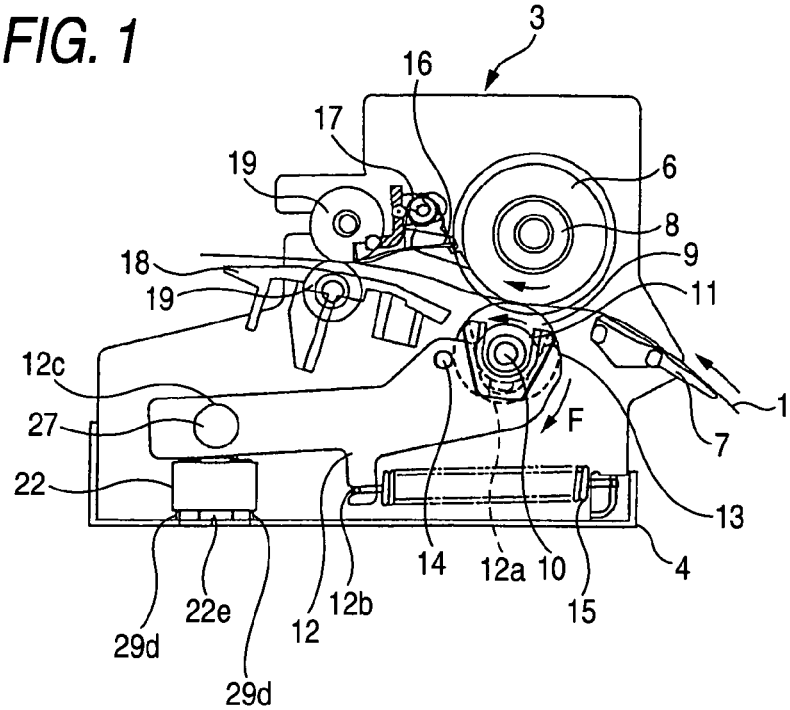
FIG. 1 is a side view illustrating a fixing apparatus having an electromagnetic valve mounting portion according to a first embodiment of the invention.
Figure 2:
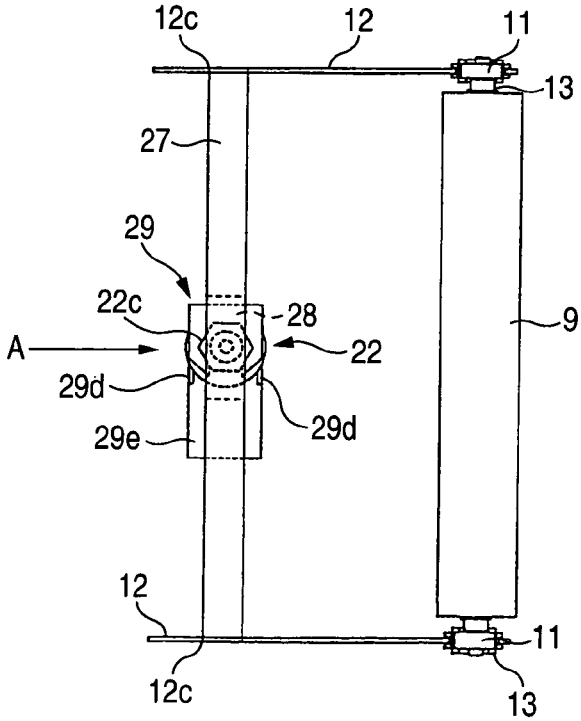
FIG. 2 is a top view illustrating a pressure releasing mechanism of the fixing apparatus according to the first embodiment of the invention shown in FIG. 1.
Figure 3:
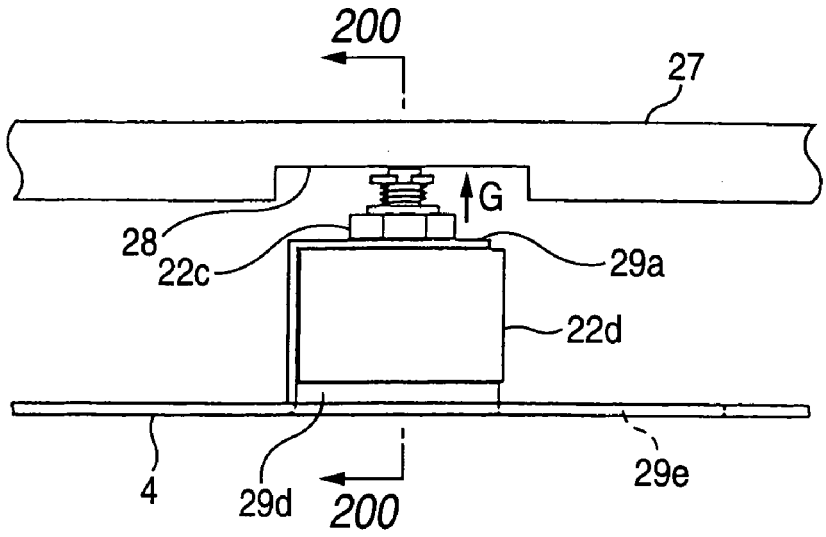
FIG. 3 is an enlarged view, which is taken in the direction of an arrow A shown in FIG. 2 and partly illustrates the mechanism shown in FIG. 2.
Figure 4:
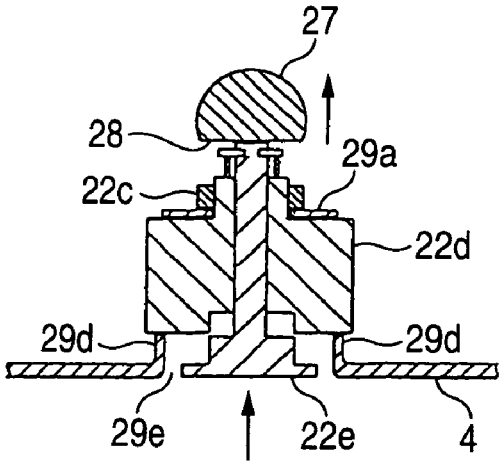
FIG. 4 is a cross-sectional view taken along line 200—200 shown in FIG. 3.
Figure 5:
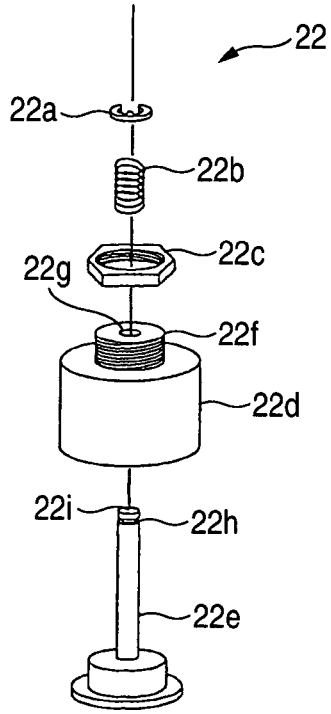
FIG. 5 is a perspective view illustrating a state in which an electromagnetic valve of the fixing apparatus according to each of the first and second embodiments of the invention are exploded.
Figure 6:
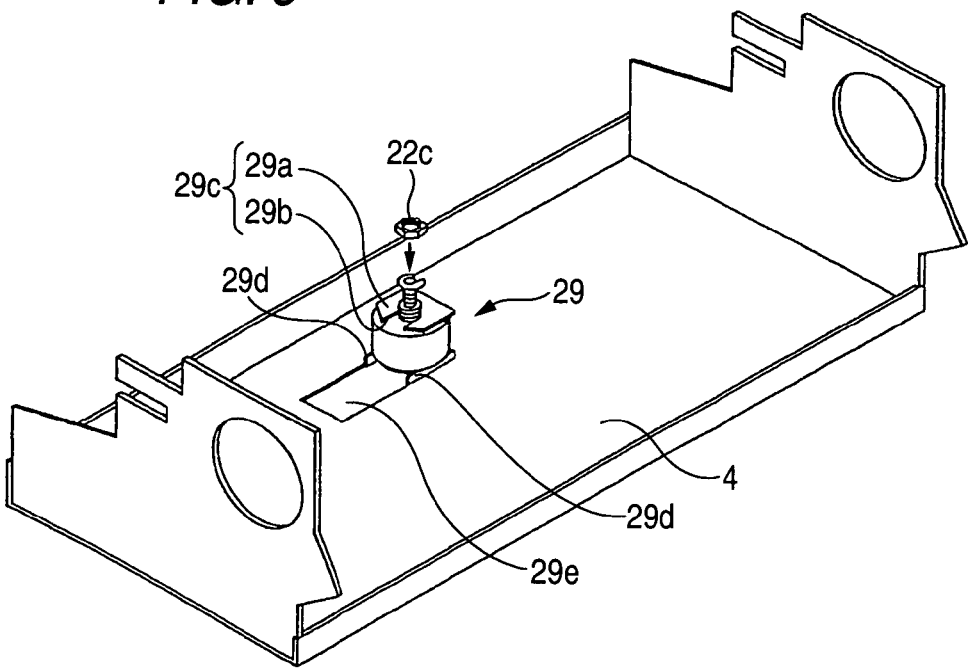
FIG. 6 is a perspective view illustrating a condition of each of the electromagnetic valve and the electromagnetic valve mounting portion of the pressure releasing mechanism of the fixing apparatus according to the first embodiment of the invention.
Figure 7:
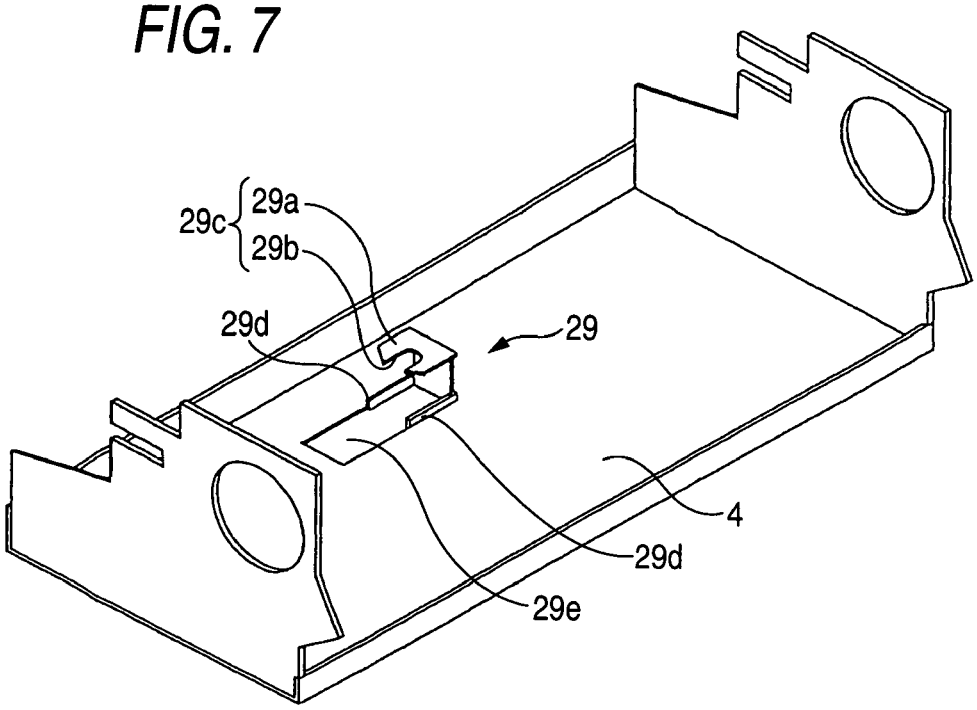
FIG. 7 is a perspective view illustrating a condition of the electromagnetic valve mounting portion of the pressure releasing mechanism of the fixing apparatus according to the first embodiment of the invention.
Figure 8:
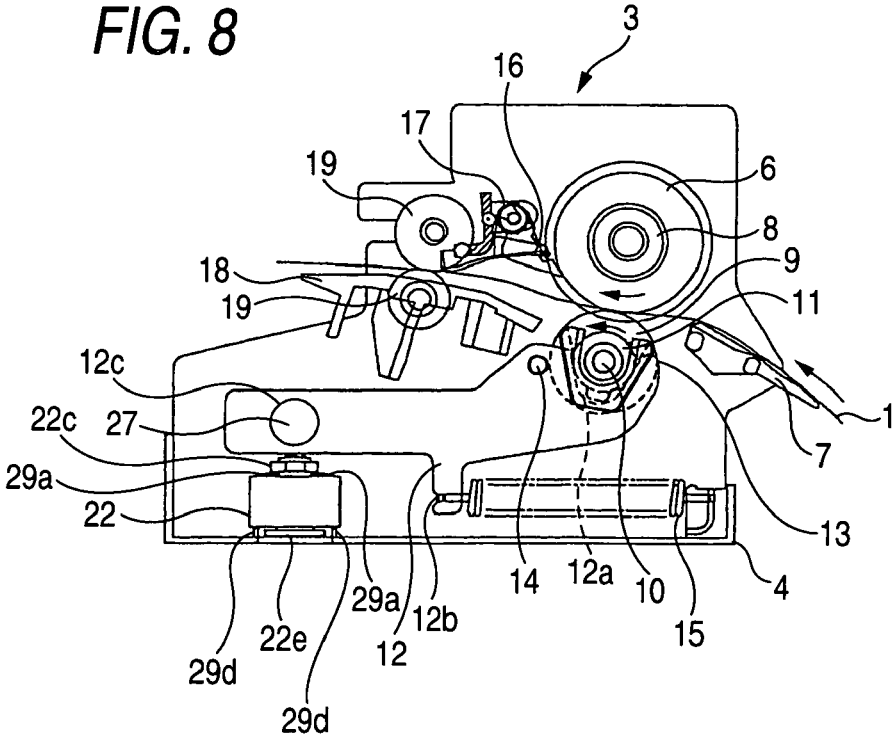
FIG. 8 is a view illustrating a condition in which the electromagnetic valve of the pressure releasing mechanism of the fixing apparatus according to the first embodiment of the invention shown in FIG. 1 is energized.
Figure 9:
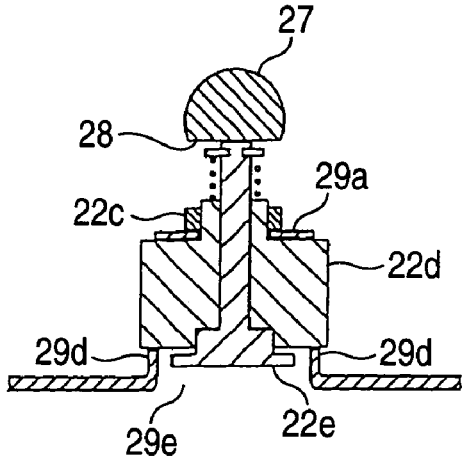
FIG. 9 is a view illustrating a condition in which the electromagnetic valve of the pressure releasing mechanism of the fixing apparatus according to the first embodiment of the invention shown in FIG. 4 is energized.

FIG. 1 is a side view illustrating a fixing apparatus having an electromagnetic valve mounting portion according to a first embodiment of the invention. FIG. 2 is a top view illustrating a pressure releasing mechanism of the fixing apparatus according to the first embodiment of the invention shown in FIG. 1. FIG. 3 is an enlarged view, which is taken in the direction of an arrow A shown in FIG. 2 and partly illustrates the mechanism shown in FIG. 2. FIGS. 5 to 7 are views illustrating the structure of each of the electromagnetic valve and the electromagnetic valve mounting portion. FIGS. 8 and 9 are views illustrating a pressure releasing state of the fixing apparatus according to the first embodiment of the invention shown in FIGS. 1 and 4. The entire structure of the fixing apparatus having a pressure releasing mechanism according to the first embodiment of the invention is described hereinbelow by referring to FIGS. 1 to 9.

First, as shown in FIG. 1, an entrance guide 7 for guiding the recording paper 1 toward the fixing roller 6 is provided at the entrance side of the fixing apparatus 3. The fixing roller 6 for fixing a toner image, which is transferred to the recording paper 1, by heating the recording paper 1 is provided in a sheet feeding direction of an entrance guide 7. This fixing roller 6 is constituted by a metallic tube, which is made of aluminum or the like and has a built-in heater (not shown) for heating the paper. Further, a Teflon coating is applied onto the surface of the fixing roller 6 so as to facilitate the separation of the recording paper 1. Moreover, two bearings for rotatably supporting the fixing roller 6 are attached to both sides of the fixing roller 6, respectively.

Furthermore, a pressure roller 9 for pressing the recording paper 1 against the fixing roller 6 is provided under the fixing roller 6 in such a way as to be brought into contact with the fixing roller 6 by a predetermined pressing force. A bearing 11 for rotatably supporting the pressure roller 9 is attached to an end portion of a shaft 10 of this pressure roller 9. This bearing 11 is held by a bearing holding member 13 fitted into a concave portion 12*a* of a crank-plate 12.

Further, this crank-plate 12 is rotatably mounted on a shaft 14 serving as a supporting point. An extension coil spring 15 is attached to a spring attaching portion 12*b* of the crank-plate 12. This extension coil spring 15 is pressed in such a way as to turn the crank-plate 12 in a direction in which the pressure roller 9 pushes the fixing roller 6. Incidentally, the extension coil spring 15 is an example of the "spring member" according to the invention.

Furthermore, a separating claw 16 is placed in the sheet feeding direction of the fixing roller 6 in such a way as to be pressed against the surface of the fixing roller 6 by an elastic force of a torsion coil spring 17. A discharge guide 18 for guiding the recording paper 1 in a discharging direction is attached to a lower portion of the torsion coil spring 17. Moreover, paired upper and lower discharging rollers 19 for discharging the recording paper 1 to the outside of the fixing apparatus 3 are provided above and under the discharge guide 18, respectively.

Incidentally, in the first embodiment, as shown in FIGS. 1 and 2, the pressure releasing mechanism of the fixing apparatus 3 includes a pair of crank-plates 12, an extension coil spring 15, a shaft member 27 for connecting the pair of crank shafts 12, an electromagnetic valve mounting portion 29 upwardly cut from a metallic frame 4, and an electromagnetic valve 22. That is, in the first embodiment, the shaft member 27 for connecting the pair of crank-plates 12 is newly provided. Conversely, the first embodiments has a configuration in which constituents respectively corresponding to the crankshaft 120, the cam 121, the cam/electromagnetic-valve mounting member 123, the axial screw 124, the nut 125, and the screw 126 of the conventional fixing apparatus shown in FIGS. 16 to 20 are omitted. Consequently, the number of components is reduced.

As shown in FIG. 1, the crank-plate 12 includes a concave portion 12*a*, a spring attaching portion 12*b* to which the extension coil spring 15 is attached, a shaft member mounting hole 12*c* provided for mounting therein the shaft member 27 that connects the pair of crank-plates 12 to each other, and a shaft 14. Furthermore, the shaft member 27 includes the flat portion 28 provided at the central portion of the bottom surface thereof, as shown in FIGS. 2 to 4.

Further, in the first embodiment, the electromagnetic mounting portion 29 is provided just under the central portion of the shaft member 27, as shown in FIG. 2. Furthermore, as shown in FIGS. 6 and 7, the electromagnetic valve mounting portion 29 includes a top stationary part 29*c*, which has a U-shaped cutout part 29*b* at a top surface part 29*a*, and a pair of bottom supporting parts 29*d*. The top stationary part 29*c* is formed by upwardly cutting the bottom surface of the metallic frame 4 and bending the upwardly cut portion like a L-shape in such a manner as to have a top surface part 29*a* extending in substantially parallel with the bottom surface thereof. Additionally, the bottom supporting part 29*d* is formed by upwardly and partly bending and processing both side portions of a bottom opening part 29*e* formed in the upwardly cut portion of the top stationary part 29*c* of the metallic frame 4. Incidentally, in the case of the first embodiment, the bent width of the bottom supporting part 29*d* is about 4.5 mm. That is, the bottom portion of the electromagnetic valve 22 is mounted therein by being upwardly lifted by the bottom supporting part 29*d* of the electromagnetic valve about 4.5 mm from the bottom surface of the frame 4. Consequently, as shown in FIG. 4, even in a case where a rod portion 22*e* of the electromagnetic valve 22 is downwardly moved in a normal state (a nonenergized state of the electromagnetic valve 22), the rod portion 22*e* does not protrude downwardly from the bottom surface of the frame 4. Thus, inconvenience of contact between a rod portion 22*e* and another member (not shown) placed under the frame does not occur.

Further, as shown in FIG. 5, the electromagnetic valve 22 includes an E-ring 22*a*, a compression coil spring 22*b*, a nut 22*c*, a body portion 22*d*, and a rod portion 22*e*. This body portion 22*d* is provided with a nut mounting portion 22*f*, and a throughhole 22*g*, through which the rod portion 22*e* is inserted. The rod portion 22*e* is provided with a groove 22*h* to which the E-ring 22*a* is fitted. Also, the rod portion 22*e* has a movable tip portion 22*i* provided at the top end thereof. Furthermore, as shown in FIGS. 2 to 4, the movable tip portion 22*i* of the electromagnetic valve 22 is mounted just under the central portion of the shaft member 27 by using the electromagnetic valve mounting portion 29 in such a way as to be upwardly directed. That is, the electromagnetic valve 22 is supported at the bottom surface of the body portion 22*d* of the electromagnetic valve 22 by a pair of the bottom supporting portions 29*d*. Moreover, the electromagnetic valve 22 is fixed to the frame 4 by sandwiching the U-shaped cutout portion 29*b* of the top stationary portion 29*c* between the body portion 22*d* of the electromagnetic valve 22 and the nut 22*c*. Furthermore, the electromagnetic valve 22 is provided at a place at which the flat portion 28 of the bottom surface of the shaft member 27 can be pushed up from below.

Next, an operation of the fixing apparatus 3 according to the first embodiment is described hereinbelow by referring to FIGS. 1, 3, 4, 8, and 9. First, the recording paper 1, on which a toner image is transferred, is guided by the entrance guide 7, and inserted into between the fixing roller 6 and the pressure roller 9. The inserted recording paper 1 is heated by the fixing roller 6 having been heated to about 200. C. Also, the recording paper 1 is pressed by the pressure roller 9 against the surface of the fixing roller 6. Consequently, the toner image, which is transferred onto the recording paper 1, is fixed thereto. Then, the fixing roller 6 rotates in a conveying direction (clockwise) to thereby feed the recording paper 1, to which the toner image is fixed, to a discharging side. Subsequently, the recording paper 1 is separated from the surface of the fixing roller 6 by the separating claw 16 provided in such a manner as to touch the surface of the fixing roller 6.

Further, an operation of the pressure releasing mechanism of the fixing apparatus 3 according to the first embodiment is performed as follows. First, when electric power is supplied to the electromagnetic valve 22 having been in a normal condition (see FIGS. 1, 3, and 4), the movable tip portion 22*i* of the electromagnetic valve 22 is driven in a direction of an arrow G in FIG. 3. Thus, the flat portion 28 of the shaft member 27 is upwardly pushed by the movable tip portion 22*i* of the electromagnetic valve 22 (see FIG. 4). Consequently, the paired crank-plates 12 turn around the shaft 14, which serves as a supporting point, against the force of the extension coil springs 15 in a direction (a direction of an arrow F in FIG. 1), respectively, so that the pressure applied to the fixing roller 6 by the pressure roller 9 is released. Thus, the pressure applied to the fixing roller 6 by the pressure roller 9 is released by the single electromagnetic valve 22 from both sides thereof.

As described above, in the first embodiment, the electromagnetic valve mounting portion 29 for mounting the electromagnetic valve 22 thereon, which constitutes the pressure releasing mechanism for releasing the pressure applied to the fixing roller 6 by the pressure roller 9, is configured by including the top stationary part 29*c*, which is formed upwardly cutting the bottom surface of the metallic frame 4 and bending the upwardly cut portion like a L-shape and which includes a top surface part 29*a* having a U-shaped cutout part 29*b*, and also including the pair of bottom supporting portions 29*d* formed by upwardly and partly bending and processing both side portions of a bottom opening part 29*e* formed in the upwardly cut portion. Thus, the electromagnetic valve mounting portion 29 can be formed by processing the metallic frame 4, to which the fixing roller 6 is attached. Consequently, the electromagnetic valve mounting portion 29 can be formed without adding a component thereto. As compared with the case of separately providing the electromagnetic valve mounting portion 29, this embodiment can reduce the number of components.

Further, in the first embodiment, the pressure releasing mechanism is formed in such a way as to include the shaft member 27, which connects the pair of crank-plates 12 to each other, and the electromagnetic valve 22 for turning the pair of crank-plates 12 against the pushing force of the spring member 15 by pushing up the central portion of the bottom surface of the shaft member 27 to thereby turn the crank-plates 12, which are provided on both sides of the mechanism, by being driven by the signal electromagnetic valve 22. Thus, the pressure applied to the fixing roller 6 by the pressure roller 9 can be released from both sides thereof. Consequently, the releasing of the pressure can uniformly be performed on both the left and right sides of a region in which the pressure roller 9 touches the fixing roller 6. Thus, wrinkles can effectively be prevented from being caused on a sealed letter, on which the fixing is performed in a state in which the pressure applied to the fixing roller 6 by the pressure roller 9 is released.

Further, in the first embodiment, the electromagnetic valve 22 can more surely push up the bottom surface of the shaft member 27 by forming the pressure releasing mechanism in such a way as to include the shaft member 27, which has the flat portion 28 at the central portion of the bottom surface thereof, and the electromagnetic valve 22 for turning the pair of crank-plates 12 against the pushing force of the spring member 15 by pushing up the central portion of the bottom surface of the shaft member 27. Thus, the pair of crank-plates 12 can more surely be turned against the pushing force of the spring member 15. Consequently, the pressure applied to the fixing roller 6 by the pressure roller 9 can more surely be released.

Second Embodiment

Figure 10:
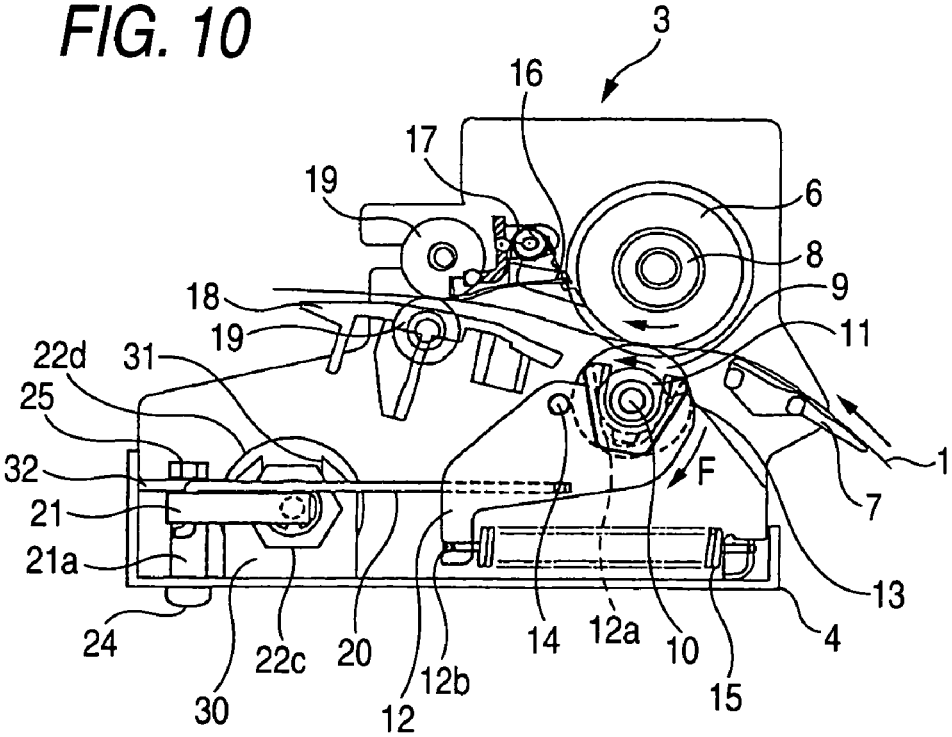
FIG. 10 is a side view illustrating the fixing apparatus having the electromagnetic valve mounting portion according to the second embodiment of the invention.
Figure 11:
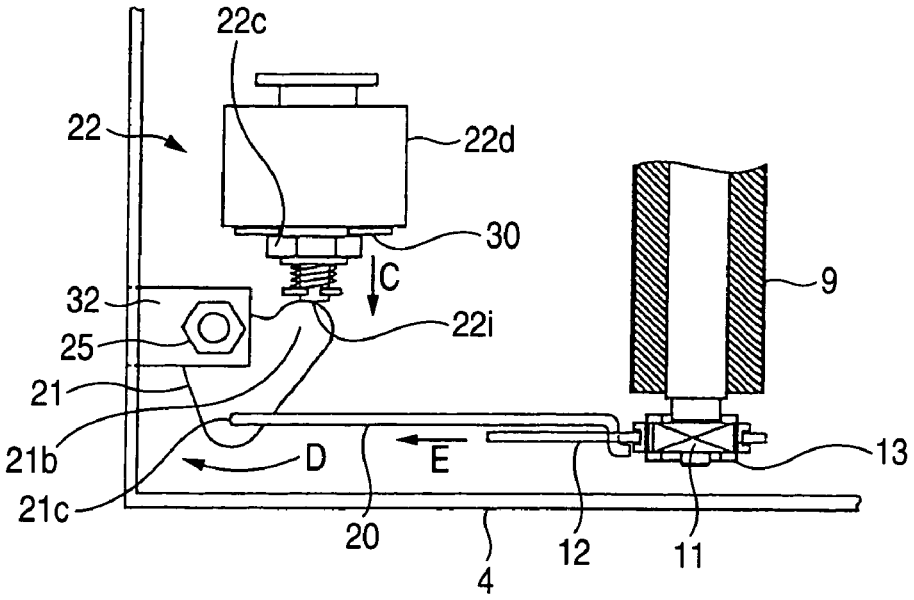
FIG. 11 is a top view illustrating the pressure releasing mechanism of the fixing apparatus according to the second embodiment of the invention.
Figure 12:
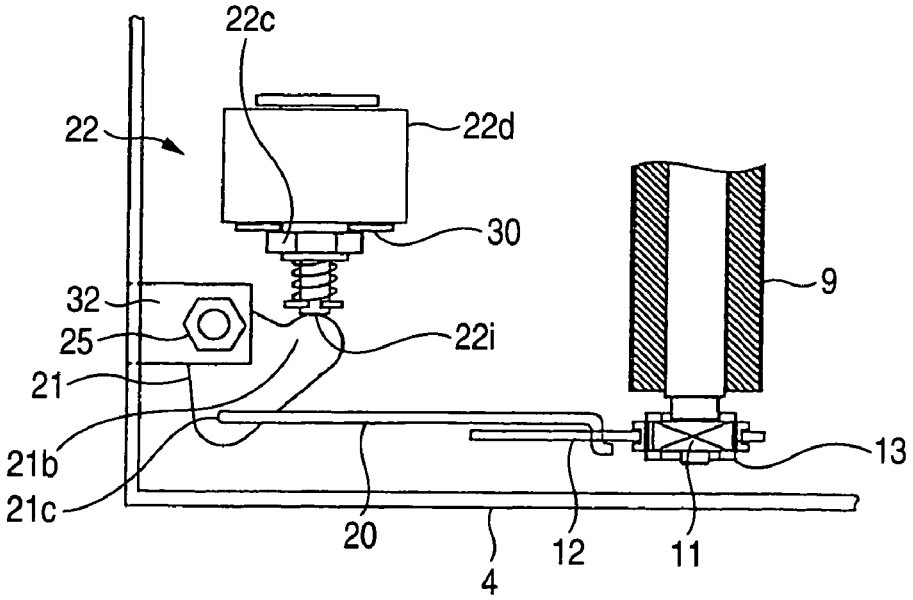
FIG. 12 is a view illustrating a condition in which the electromagnetic valve of the pressure releasing mechanism of the fixing apparatus according to the second embodiment of the invention shown in FIG. 11 is energized.
Figure 13:
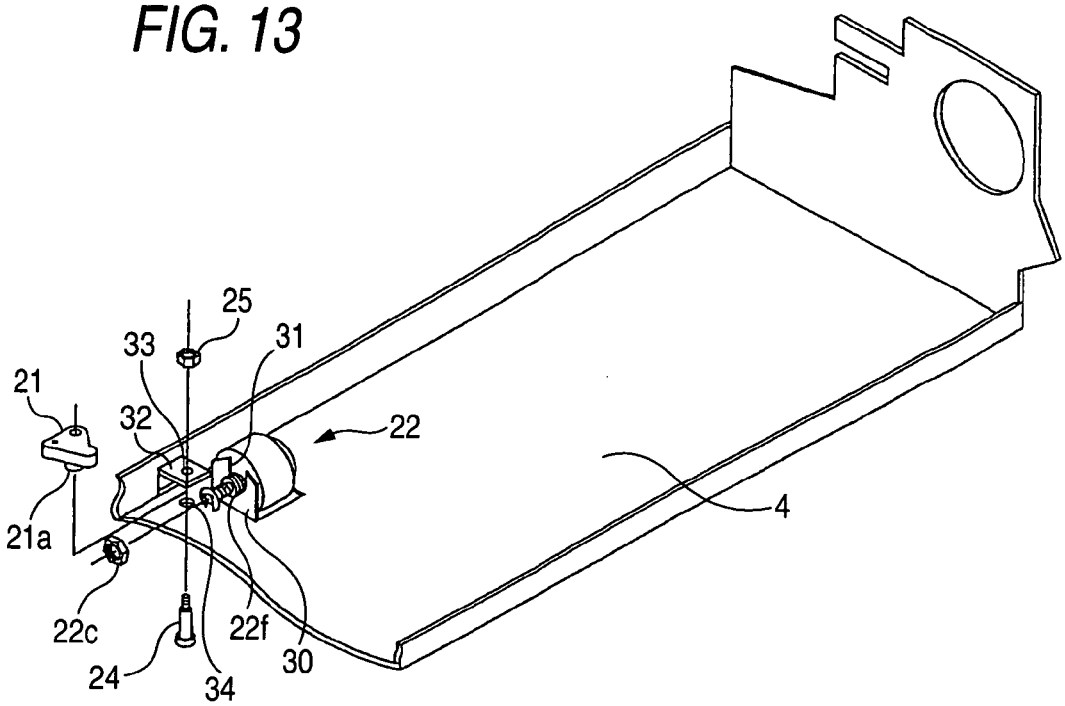
FIG. 13 is a perspective view illustrating a condition in which the electromagnetic valve and a cam are mounted in the fixing apparatus according to the second embodiment of the invention.
Figure 14:
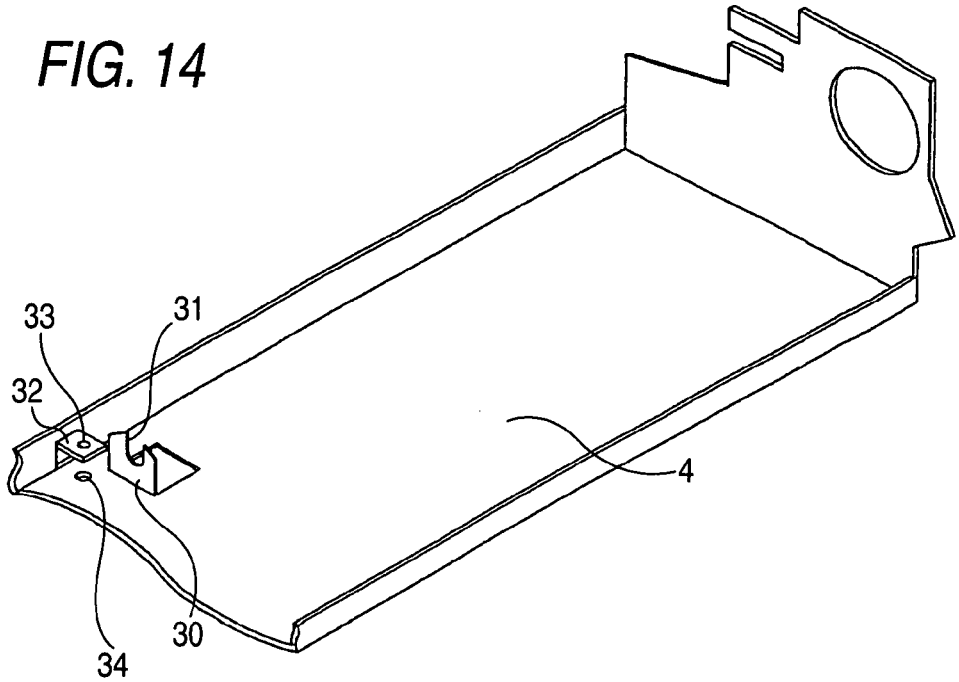
FIG. 14 is a perspective view illustrating a condition of each of the electromagnetic valve mounting portion and a cam mounting portion in the pressure releasing mechanism of the fixing apparatus according to the second embodiment of the invention.
Figure 15:
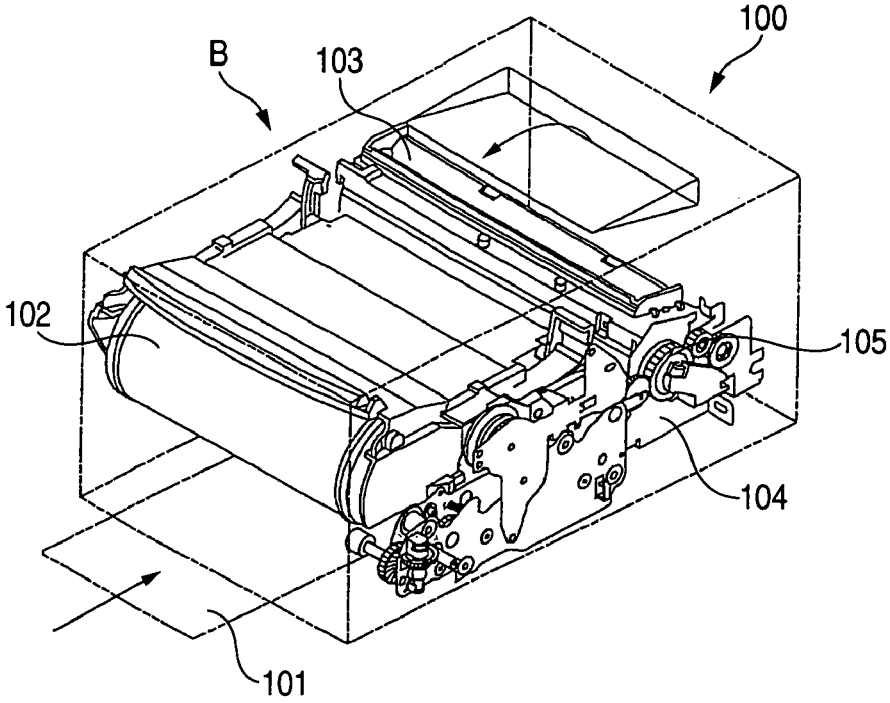
FIG. 15 is a perspective view illustrating the entire configuration of a laser printer including a conventional fixing apparatus provided with a pressure releasing mechanism.
Figure 16:
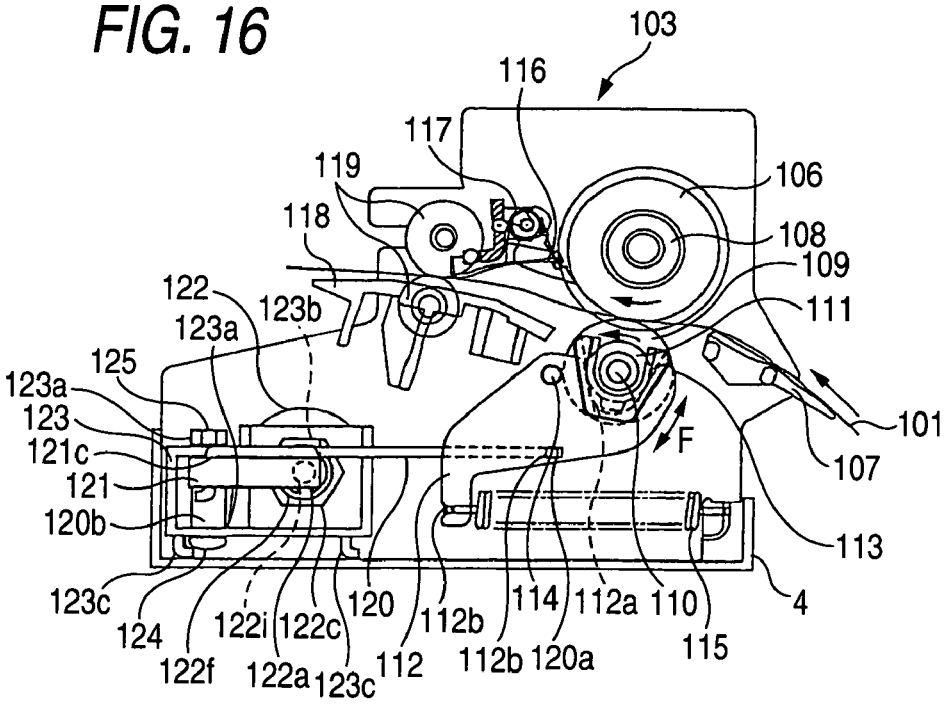
FIG. 16 is a side view taken in the direction of an arrow B, which illustrates the conventional fixing apparatus of the laser printer shown in FIG. 15.
Figure 17:
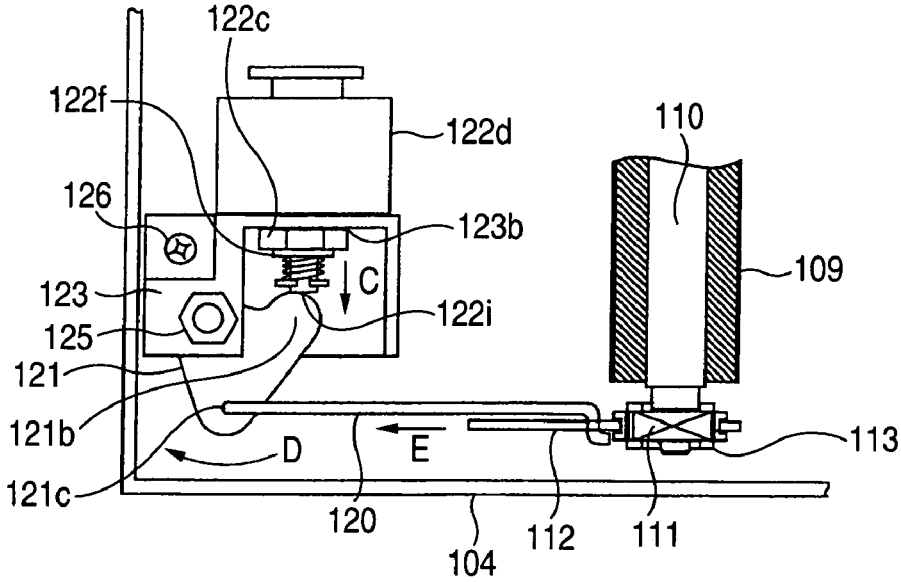
FIG. 17 is a top view illustrating a pressure releasing mechanism of the conventional fixing apparatus shown in FIG. 16.
Figure 18:
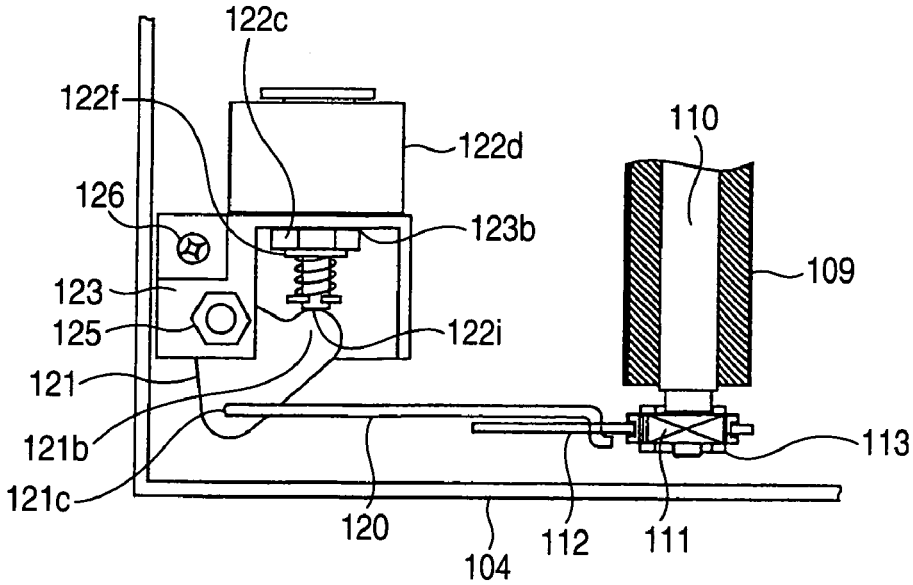
FIG. 18 is a view illustrating a condition in which the electromagnetic valve of the pressure releasing mechanism of the conventional fixing apparatus shown in FIG. 17 is energized.
Figure 19:
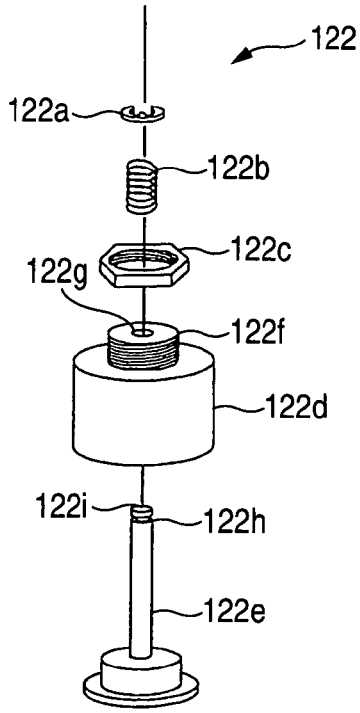
FIG. 19 is a perspective view illustrating a condition in which the electromagnetic valve of the pressure releasing mechanism of the conventional fixing apparatus is exploded.
Figure 20:
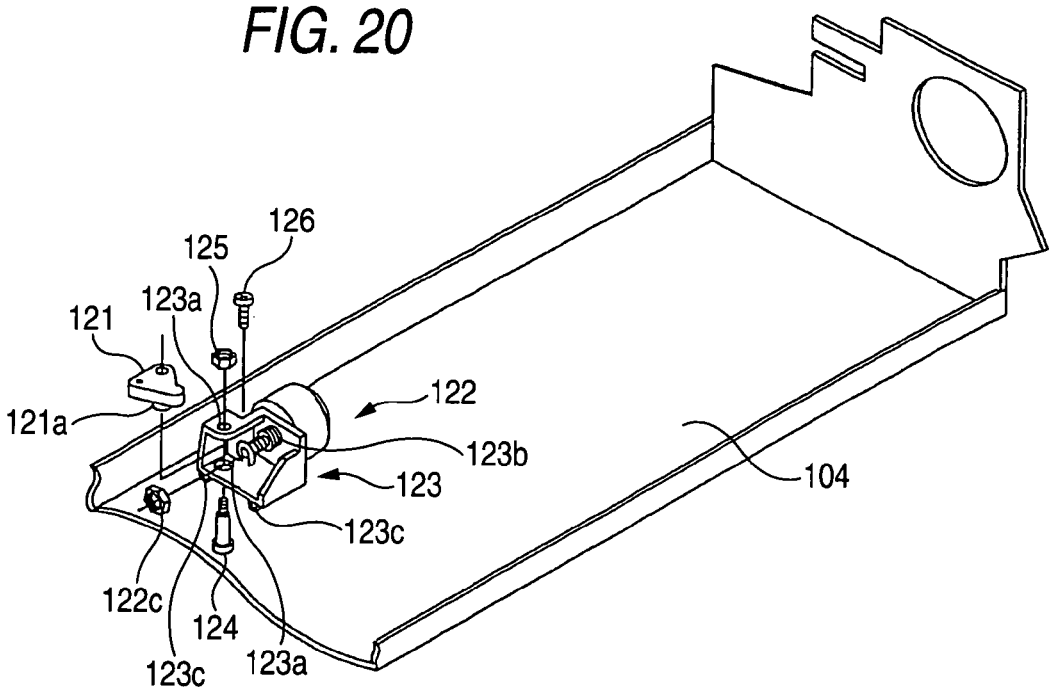
FIG. 20 is a perspective view illustrating a state in which the electromagnetic valve and a cam are mounted in the pressure releasing mechanism of the conventional fixing apparatus.

FIG. 10 is a side view illustrating a fixing apparatus having an electromagnetic valve mounting portion according to a second embodiment of the invention. FIG. 11 is a top view illustrating a pressure releasing mechanism of the fixing apparatus according to the second embodiment of the invention, which is shown in FIG. 10. FIG. 12 is a view illustrating a condition in which the electromagnetic valve of the pressure releasing mechanism of the fixing apparatus according to the second embodiment of the invention shown in FIG. 11 is energized. FIG. 13 is a perspective view illustrating a condition in which the electromagnetic valve and a cam are mounted in the fixing apparatus according to the second embodiment of the invention. FIG. 14 is a perspective view illustrating a condition of each of the electromagnetic valve mounting portion and a cam mounting portion in the pressure releasing mechanism of the fixing apparatus according to the second embodiment of the invention. Next, the entire structure of the fixing apparatus having the electromagnetic valve mounting portion according to the second embodiment of the invention is described hereinbelow by referring to FIGS. 10 to 14. Incidentally, the remaining structure of the apparatus other than the pressure releasing mechanism of the second embodiment is similar to that of the first embodiment.

That is, as shown in FIGS. 10 and 11, an electromagnetic valve mounting portion 30 and a cam mounting portion 32, which are formed by upwardly cutting the frame 4, are provided in this second embodiment. Meanwhile, this embodiment has a configuration in which constituents being respectively equivalent to the cam/electromagnetic-valve mounting member 123 and the screw 126 of the pressure releasing mechanism of the conventional fixing apparatus shown in FIGS. 16 to 20 are omitted. Consequently, the number of components is reduced.

As shown in FIG. 14, the electromagnetic valve mounting portion 30 is formed by upwardly perpendicularly cutting the bottom surface of the metallic frame 4, and has a U-shaped cutout portion 31. Also, as shown in FIG. 14, the cam mounting portion 32 is formed by partly bending the metallic frame 4, and has an axial screw insertion hole 33 into which an axial screw 24 is inserted. Also, the metallic frame 4 is provided with an axial screw insertion hole 34 into which the axial screw 24 is inserted. In this case, as shown in FIG. 13, the electromagnetic valve 22 is fixed to the frame 4 by fitting a nut mounting portion 22*f* of the electromagnetic valve 22 into the U-shaped cutout portion 31 of the electromagnetic valve mounting portion 30 and by sandwiching this nut mounting portion between the body portion 22*d* of the electromagnetic valve 22 and the nut 22*c*. Further, as shown in FIG. 13, the cam 21 is provided at the cam mounting portion 32 in such a way as to be able to be turned around the cam shaft 21*a*, which serves as a supporting point, by the axial screw 24, which is inserted into the axial screw insertion hole 33 of the cam mounting portion 32 and the axial screw insertion hole 34 provided in the frame 4, and the nut 25.

An operation of the pressure releasing mechanism of the fixing apparatus 3 according to the second embodiment is performed as follows. First, when electric power is supplied to the electromagnetic valve 22 having been in a normal condition (see FIG. 11), the movable tip portion 22*i* of the electromagnetic valve 22 is driven in a direction of an arrow C in FIG. 11. Consequently, the electromagnetic valve abutting portion 21*b* is pressed by the movable tip portion 22*i* of the electromagnetic valve 22. Thus, the cam 21 turns around the cam shaft 21*a* serving as a supporting point (see FIG. 13) in a direction of an arrow D in FIG. 11. Then, the turn of the cam 21 in the direction of the arrow D in FIG. 11 causes the crankshaft 20, which connects the cam 21 to the crank-plate 12, to operate in such a way as to pull the crank-plate 12 horizontally (in a direction of an arrow E shown in FIG. 11). Consequently, the crank-plate 12 turns around the shaft 14, which serves as a supporting point, against the force of the extension coil spring 15 in a direction (a direction of an arrow F in FIG. 10), so that the pressure applied to the fixing roller 6 by the pressure roller 9 is released. Thus, the apparatus is put into a condition shown in FIG. 12. Consequently, the pressing force of the pressure roller 9 is released.

As described above, in the second embodiment, the electromagnetic valve mounting portion 30 having a U-shaped cutout portion 31, on which an electromagnetic valve 22 is mounted, is provided by upwardly perpendicularly cutting the bottom surface of the metallic frame 4. Moreover, the cam mounting portion 32 for mounting the cam 21 thereon is provided by bending a part of the metallic frame 4. Thus, the electromagnetic valve mounting portion 30 and the cam mounting portion 32 can be formed by processing the metallic frame 4, to which the fixing roller is attached. Consequently, the electromagnetic valve mounting portion 30 and the cam mounting portion 32 can be formed without adding a component to the apparatus. Therefore, as compared with the case of separately providing the electromagnetic valve mounting portion 30 and the cam mounting portion 32 in the apparatus, the number of components can be reduced.

Incidentally, it should be understood that the embodiments disclosed herein are illustrative in all respects, and that the invention is not limited thereto. The scope of the invention is defined by the scope of the appended claims rather than by the description of the embodiments. Furthermore, all changes that fall within the scope of the claims, or equivalence of the scope of the claims, are included by the scope of the invention.

For example, although examples of applying the invention to the fixing apparatus for use in the laser printer have been disclosed in the descriptions of the first and second embodiments, the invention is not limited thereto. The invention is not limited thereto. The invention may be applied to fixing apparatuses for use in image forming apparatuses other than laser printers, and to fixing apparatuses for use in apparatuses other than image forming apparatuses.

Further, although the bent width of the bottom supporting part of the electromagnetic valve mounting portion is set to be about 4.5 mm in the first embodiment, the invention is not limited thereto. The bottom supporting part of the electromagnetic valve mounting portion may have any bent width, as long as the rod portion of the electromagnetic valve does not touch other components when moved downwardly during energization thereof is interrupted.

Additionally, although the flat portion of the shaft member is provided at the central portion of the bottom surface of the shaft member, the invention is not limited thereto. The flat portion may be provided on the entire bottom surface of the shaft member. Alternatively, the flat portion may be provided at a part other than the central portion of the bottom surface thereof.

What is claimed is:

1. A fixing apparatus comprising:

a fixing roller, rotatably attached to a metallic frame, for fixing an image transferred to recording paper by heat;

a pressure roller for pressing the recording paper against the fixing roller;

a pressure releasing mechanism for releasing a pressure applied to the fixing roller by the pressure roller; and an electromagnetic valve mounting portion for mounting the electromagnetic valve thereon, wherein the pressure releasing mechanism includes a pair of crank-plates each supporting the pressure roller and being turnable around a predetermined supporting point, a spring member for pushing the pair of crank-plates in a direction so that the pressure applied to the fixing roller by the pressure roller is not released, a shaft member connecting the pair of crank-plates to each other and having a flat portion provided on a central portion of a bottom surface thereof, and an electromagnetic valve for turning the pair of crank-plates against a pushing force of the spring member by pushing up the central portion of the bottom surface of the shaft member; and the electromagnetic valve mounting portion includes a top stationary portion that is formed by upwardly cutting the bottom surface of the frame and then bending an upwardly cut part of the bottom surface like a L-shape in such a way as to have a top surface part extending in substantially parallel with the bottom surface and that has a U-shaped cutout part in the top surface part, and also includes a pair of bottom supporting portions formed by upwardly bending both side parts of a bottom opening portion formed in the upwardly cut part.

2. A fixing apparatus comprising:

a fixing roller, rotatably attached to a metallic frame, for fixing an image transferred to recording paper by heat;

a pressure roller for pressing the recording paper against the fixing roller;

a pressure releasing mechanism for releasing a pressure applied to the fixing roller by the pressure roller;

an electromagnetic valve mounting portion, formed by upwardly perpendicularly cutting a bottom surface of the metallic frame, for mounting thereon the electromagnetic valve having a U-shaped cutout portion; and a cam mounting portion, formed by bending a part of the metallic frame, for mounting the cam thereon, wherein the pressure releasing mechanism includes a pair of crank-plates each supporting the pressure roller and being turnable around a predetermined supporting point, a spring member for pushing the pair of crank-plates in a direction so that the pressure applied to the fixing roller by the pressure roller is not released, a shaft member connecting the pair of crank-plates to each other and having a flat portion provided on a central portion of a bottom surface thereof, and an electromagnetic valve for turning the pair of crank-plates against a pushing force of the spring member by pushing up the central portion of the bottom surface of the shaft member.

3. A fixing apparatus comprising:

a fixing roller, attached to a metallic frame, for fixing an image transferred to recording paper by heat;

a pressure roller for pressing the recording paper against the fixing roller; and a pressure releasing mechanism for releasing a pressure applied to the fixing roller by the pressure roller, wherein:

the pressure releasing mechanism includes an electromagnetic valve serving as a drive source; and the metallic frame includes an electromagnetic valve mounting portion for mounting thereon an electromagnetic valve, and wherein the electromagnetic valve mounting portion includes a top stationary portion that is formed by upwardly cutting the bottom surface of the frame and then bending an upwardly cut part of the bottom surface like a L-shape in such a way as to have a top surface part extending in substantially parallel with the bottom surface and that has a U-shaped cutout part in the top surface part, and also includes a pair of bottom supporting portions formed by upwardly bending both side parts of a bottom opening portion formed in the upwardly cut part.

4. The fixing apparatus according to claim 3, wherein:

the pressure releasing mechanism includes a pair of crank-plates each supporting the pressure roller and being turnable around a predetermined supporting point, a spring member for pushing the pair of crank-plates in a direction so that the pressure applied to the fixing roller by the pressure roller is not released, and a connecting portion for connecting the pair of crank-plates to each other; and an electromagnetic valve is provided in such a way as to turn the pair of crank-plates against a pushing force of the spring member by depressing a bottom surface of the connecting member.

5. The fixing apparatus according to claim 4, wherein:

the connecting member includes a shaft member having a circular cross-section that has a flat portion at a predetermined place of a bottom surface thereof; and the electromagnetic valve is placed in such a way as to turn the pair of crank-plates against a pushing force of the spring member by depressing a flat portion of the bottom surface of the connecting member.

6. An image forming apparatus comprising a fixing apparatus including:

a fixing roller, attached to a metallic frame, for fixing an image transferred to recording paper by heat;

a pressure roller for pressing the recording paper against the fixing roller; and a pressure releasing mechanism for releasing a pressure applied to the fixing roller by the pressure roller, wherein:

the pressure releasing mechanism includes an electromagnetic valve serving as a drive source; and the metallic frame includes an electromagnetic valve mounting portion for mounting thereon an electromagnetic valve, and wherein the electromagnetic valve mounting portion includes a top stationary portion that is formed by upwardly cutting the bottom surface of the frame and then bending an upwardly cut part of the bottom surface like a L-shape in such a way as to have a top surface part extending in substantially parallel with the bottom surface and that has a U-shaped cutout part in the top surface part, and also includes a pair of bottom supporting portions formed by upwardly bending both side parts of a bottom opening portion formed in the upwardly cut part.

* * * * *